United States Patent [19]

Wang

[11] Patent Number: 4,732,303

[45] Date of Patent: Mar. 22, 1988

[54] BOTTLE COVER WITH DISPENSING SPOUT

[76] Inventor: Paul S. Wang, 16033 Villa Flores Dr., Hacienda Heights, Calif. 91745

[21] Appl. No.: 934,494

[22] Filed: Nov. 24, 1986

[51] Int. Cl.[4] ..... B67D 3/00

[52] U.S. Cl. ..... 222/484; 222/534; 222/536; 222/517

[58] Field of Search ..... 222/484, 536, 517, 534

[56] References Cited

U.S. PATENT DOCUMENTS

| | | | |
|---|---|---|---|
| 2,979,238 | 4/1961 | Brammity | 222/536 |
| 3,148,522 | 9/1964 | Court | 222/536 |
| 3,283,967 | 11/1966 | Akers | 222/536 |
| 3,502,248 | 3/1970 | Libit et al. | 222/536 |
| 4,519,529 | 5/1985 | Seltz | 222/484 |

*Primary Examiner*—H. Grant Skaggs
*Attorney, Agent, or Firm*—Keith D. Beecher

[57] ABSTRACT

A cover assembly for a thermos, or other bottle, which includes a dispensing spout which is movable between a closed and an open position. The dispensing spout has an opening extending through it which becomes aligned with an opening in the cover when the spout is turned to its open position. The spout also includes a vent which becomes aligned with a vent in the cover when the spout is in its open position. The opening and vent in the cover are both closed and sealed by the spout when the spout is turned down to its closed position. The spout is held in its open and closed positions by a snap-acting leaf spring element which causes the spout to be snapped to its open or closed position when the spout is turned manually in one direction or the other. The dispensing spout may be used either to pour the contents out of the bottle, or to receive a drinking straw into the interior of the bottle.

2 Claims, 8 Drawing Figures

BOTTLE COVER WITH DISPENSING SPOUT

BACKGROUND OF THE INVENTION

The cover assembly of the present invention is of the same general type disclosed in U.S. Pat. No. 4,519,529. However, the movable spout in the assembly of the present invention is held more positively in its open and closed positions by the snap action of an over-center leaf-spring which engages trunions extending outwardly from the spout.

The cover assembly of the invention will be described in conjunction with a thermos bottle. However, it will become evident as the description proceeds that the assembly may be used in conjunction with other types of bottles.

In all cases the dispensing spout may be snapped into the plane of the cover to its closed position at which all orifices and openings through the cover are sealed closed; or it may be snapped to its upright position, at which the dispensing openings and vents in the cover are opened to permit the contents of the bottle to be freely poured through the dispensing openings, or to permit a drinking straw to be inserted through the openings into the bottle.

DETAILED DESCRIPTION OF THE ILLUSTRATED EMBODIMENT

Figure 2:
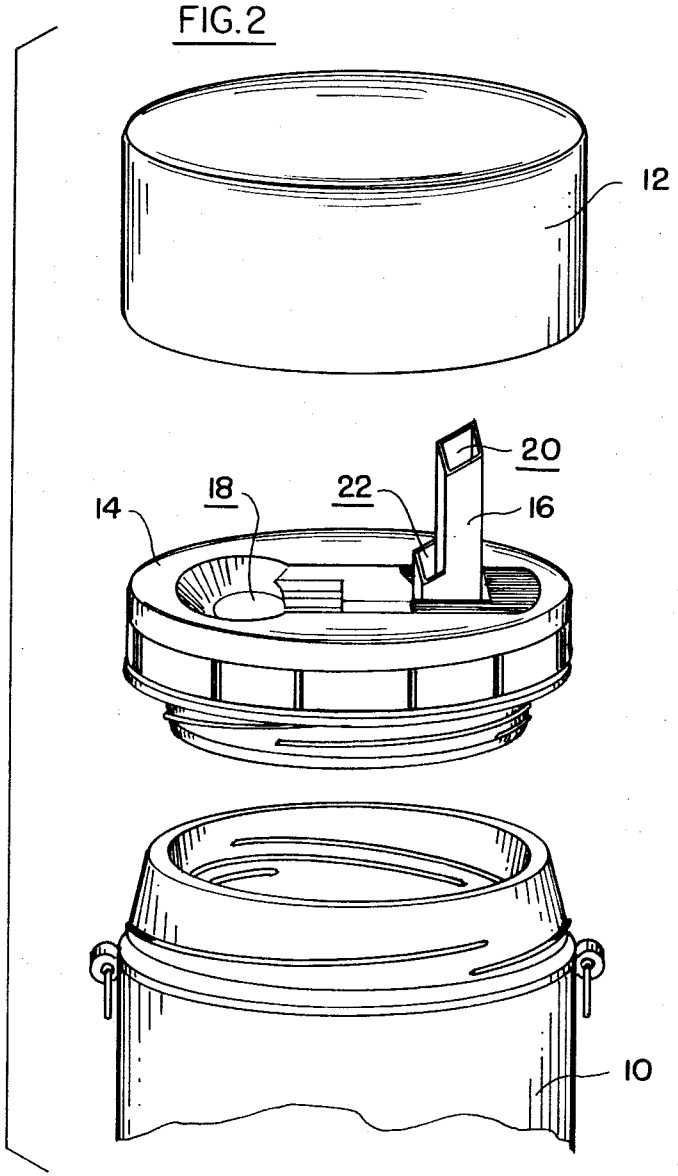
FIG. 2 is an exploded perspective view of the bottle of FIG. 1.
Figure 1:
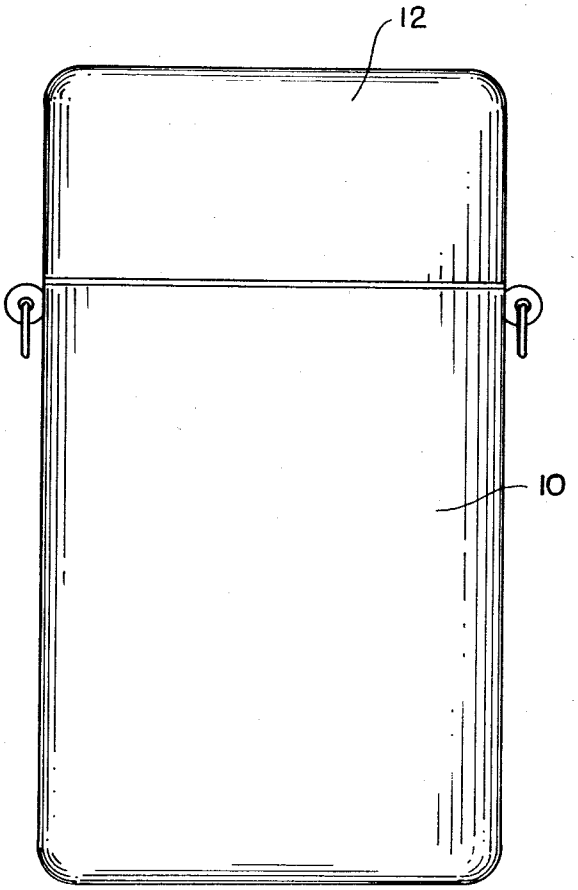
FIG. 1 is a side elevational view of a thermos bottle which may be constructed to incorporate the teachings of the present invention.

The bottle shown in the drawings may be formed of any appropriate plastic or other suitable material. The bottle includes a body section 10 and a top 12 which is screwed onto the body section. The body section may have a double wall construction as is usual in thermos bottles.

An inner cover 14 is screwed into the open top of the body 10. A spout 16 is mounted in a well 18 in cover 14. Spout 16 may be turned between an upright open position, as shown, and it also may be turned down into the well 18 to a closed position.

Figure 6:
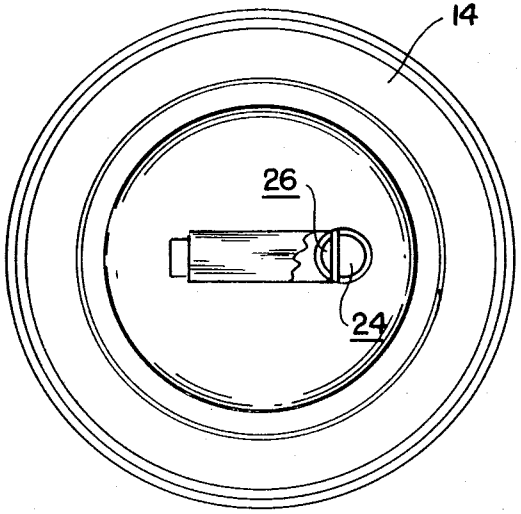
FIG. 6 is a bottom view of the cover of FIG. 3.

The spout 16 includes a dispensing opening 20 which extends from one end of the spout to the other, and it also includes a vent opening 22 which also extends from one end of the spout to the other. The cover 14 has a dispensing opening 24 (FIG. 6), and it also has a vent opening 26. When the spout 16 is in the upright position shown in FIGS. 2, 4B and 5B its dispensing opening 20 is aligned with the dispensing opening 24 in cover 14, and its vent 22 is aligned with vent 26 in the cover.

Accordingly, when the spout is in its upright position, the contents of the bottle may be freely poured through the aligned dispensing openings 24 and 20. Alternately, a drinking straw may be inserted into the interior of the bottle through the dispensing openings 20 and 24. When the spout is turned down to the closed position shown in FIGS. 3, 4A and 5A it covers the openings 24 and 26 in the cover, effectively sealing those openings. Spout 16 has a pair of integral trunions 28, as best shown in FIGS. 5A and 5B, which engage the arms of a bifurcated resilient leaf spring 30.

Figure 4A:
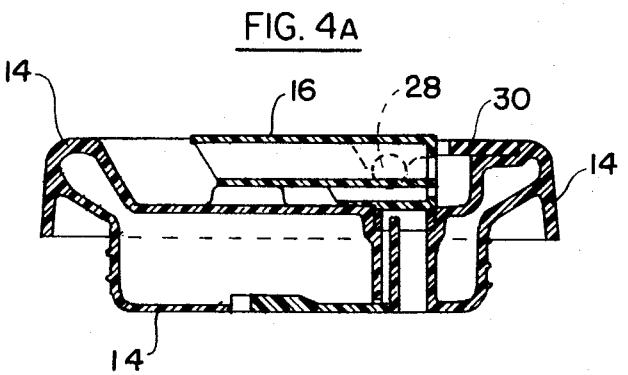
FIGS. 4A and 4B are cross-sectional views taken along the line 4—4 of FIG. 3 and showing the dispensing spout respectively in its open and closed positions.
Figure 4B:
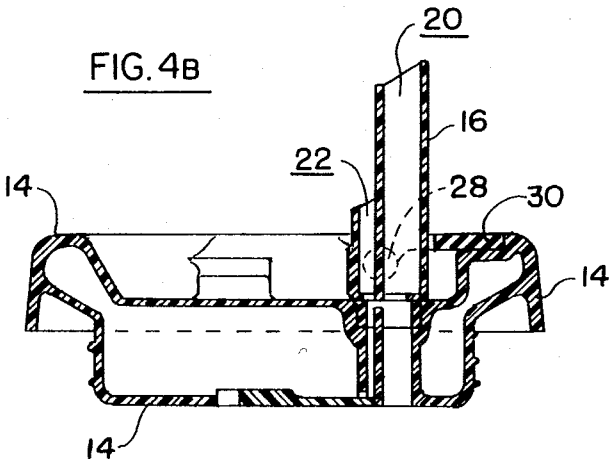
Figure 3:
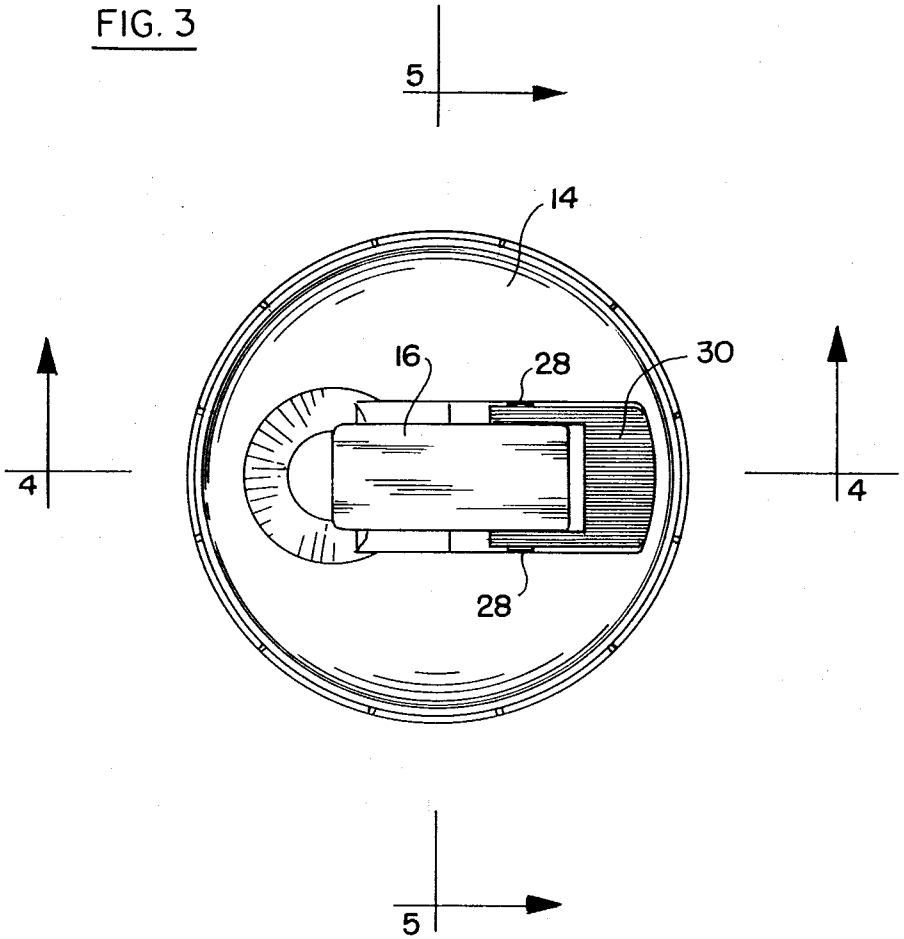
FIG. 3 is a top plan view of the cover of the bottle of FIG. 2.
Figure 5A:
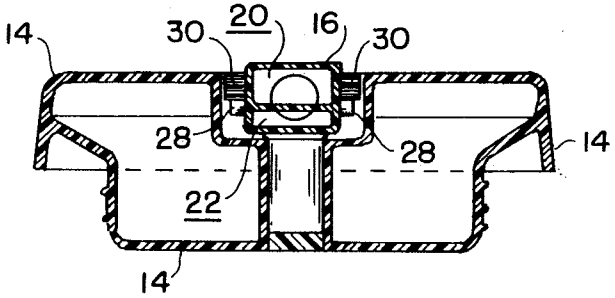
FIGS. 5A and 5B are cross-sectional views taken along the line 5—5 of FIG. 3 and also showing the spout respectively in its open and in its closed positions.
Figure 5B:
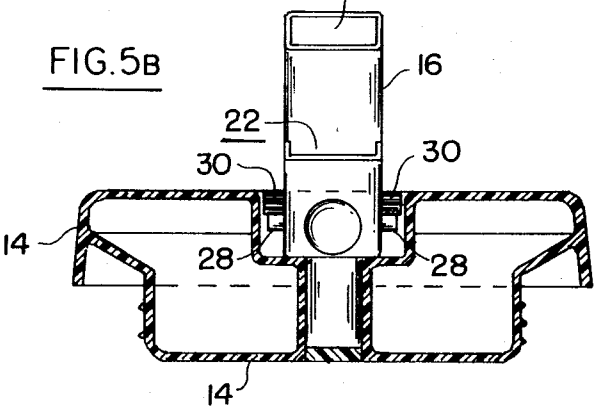

The spout 16 has a rectangular section, so that when it is turned from its closed position shown in FIGS. 3, 4A and 5A to its open position shown in FIGS. 2, 4B and 5B the trunions move upwardly against the arms of the leaf spring element 30, forcing the arms upwardly until the spout reaches the upright position of FIG. 2, at which time the arms move downwardly in an off-center action causing the spout to be held securely in its open position.

On the other hand, when the spout is turned down from its open position of FIGS. 2, 4B and 5B to its closed position of FIGS. 3, 4A and 5A the trunions 28 again move upwardly against the arms of leaf spring element 30 until the spout reaches a particular angular position at which time, the trunions move downwardly, under the bias pressure of the arms of leaf spring 30, and the spout then moves with a snap action to its closed position. The spout is securely held in either its closed position or its open position by the resilient force of the arms of leaf spring 30.

The invention provides, therefore, an improved closure assembly for a bottle which includes a spout which engages a leaf spring, and which may be turned in a snap-acting manner to either its open position or its closed position. The spout is securely held in either its open position or its closed position by the action of the leaf spring.

It will be appreciated that while a particular embodiment of the invention has been shown and described, modifications may be made. It is intended in the claims to cover all such modifications which come within the spirit and scope of the invention.

I claim:

1. A dispensing cover assembly for a bottle, or the like, having an open top, comprising: a cover adapted to be mounted on the bottle to enclose the open top, said cover having a dispensing opening extending therethrough; a dispensing spout rotatably mounted on said cover to be turned to an open upright position and to a closed down position parallel to the plane of said cover, said spout having an opening extending therethrough which is aligned with said dispensing opening in said cover when said dispensing spout is turned to its upright position, and said dispensing spout closing the dispensing opening in said cover when the spout is turned down to its closed position; a snap-acting leaf spring element mounted on said cover and engaging said spout to hold said spout in its open and in its closed positions, said leaf spring element having a bifurcated shape with first and second spaced and parallel resilient arms extending along each side of said spout, a pair of trunions attached to said spout and extending outwardly from each side of said spout under respective ones of said arms, and said spout having a rectangular configuration of force said trunions upwardly against said resilient arms when the spout is turned from its closed to its open position until the spout reaches an upright position at which the arms move downwardly in an off-center action causing the spout to be held in its open position, and to force the trunions upwardly against said arms when the spout is turned down from its open position until the spout reaches a particular angular position at which the arms move downwardly in an off-center action biasing the spout with a snap action to its closed position.

2. The dispensing cover assembly defined in claim 1, in which said cover has a vent opening therein and said spout has a vent opening therein which is aligned with the vent opening in said cover when the spout is in its open position, and said spout closing said vent opening in said cover when said spout is in its closed position.

* * * * *